US012679577B2

(12) United States Patent
Kruchowy et al.

(10) Patent No.: US 12,679,577 B2
(45) Date of Patent: Jul. 14, 2026

(54) PREDICTING MACHINE PARAMETERS TO ACHIEVE TARGET SYRINGE PLUNGER DEPTH PLACEMENT

(71) Applicant: AMGEN INC., Thousand Oaks, CA (US)

(72) Inventors: Evan Kruchowy, Port Hueneme, CA (US); David L. Le, Thousand Oaks, CA (US); Vikashni Padmakumar, Thousand Oaks, CA (US); Joseph P. Bernacki, Thousand Oaks, CA (US)

(73) Assignee: AMGEN INC., Thousand Oaks, CA (US)

( * ) Notice: Subject to any disclaimer, the term of this patent is extended or adjusted under 35 U.S.C. 154(b) by 50 days.

(21) Appl. No.: 18/877,730

(22) PCT Filed: Jun. 20, 2023

(86) PCT No.: PCT/US2023/025692

§ 371 (c)(1),
(2) Date: Dec. 20, 2024

(87) PCT Pub. No.: WO2023/249922

PCT Pub. Date: Dec. 28, 2023

(65) Prior Publication Data

US 2025/0382080 A1 Dec. 18, 2025

Related U.S. Application Data

(60) Provisional application No. 63/354,102, filed on Jun. 21, 2022.

(51) Int. Cl.
*B65B 3/00* (2006.01)
*B65B 31/02* (2006.01)

(52) U.S. Cl.
CPC ..... *B65B 3/003* (2013.01); *B65B 31/027* (2013.01)

(58) Field of Classification Search
CPC ..... B65B 3/003; B65B 1/027; B16H 20/17; B16H 70/40; B16H 40/20
See application file for complete search history.

(56) References Cited

U.S. PATENT DOCUMENTS

2016/0340066 A1* 11/2016 Perazzo ..... B65B 3/003
2019/0351132 A1* 11/2019 Pippin ..... A61M 5/142
2022/0301681 A1* 9/2022 Coetzee ..... G16H 50/50

FOREIGN PATENT DOCUMENTS

WO WO-2021/188319 A1 9/2021

OTHER PUBLICATIONS

International Search Report and Written Opinion for International Application No. PCT/US2023/025692, dated Oct. 6, 2023, 11 pages.

* cited by examiner

*Primary Examiner* — Jason K Niesz
(74) *Attorney, Agent, or Firm* — MARSHALL, GERSTEIN & BORUN LLP

(57) ABSTRACT

Systems and methods for characterizing a recipe of a syringe filling system can include (a) receiving a value of a plunger depth for a syringe, (b) receiving values of product parameters, (c) determining, by applying the value of the plunger depth and the values of the product parameters as inputs to a model, values of vacuum parameters of the syringe filling system for use when filling the syringe with a product having the values of the product parameters, and (d) displaying or storing the values of the vacuum parameters. Further aspects include characterizing a recipe of the syringe filling system for use with a second value of the plunger depth for a second syringe. Still further aspects include causing one or more (Continued)

vacuum devices of the syringe filling system to operate at the values of the vacuum parameters.

19 Claims, 8 Drawing Sheets

300

Plunger Depth Average (mm)

| Vacuum (PSI) | 0.25 | 0.45 | 0.65 | 0.85 | 1.05 |
|---|---|---|---|---|---|
| 0.5 | 36.96 | 31.42 | 24.56 | 18.88 | |
| 1.0 | 35.08 | 29.54 | 23.12 | 17.83 | 12.03 |
| 1.5 | 33.43 | 28.18 | 22.05 | 16.98 | 10.91 |
| 2.0 | 31.96 | 27.25 | 21.02 | 15.96 | 10.18 |
| 2.5 | 30.58 | 25.93 | 19.84 | 14.95 | 9.55 |
| 3.0 | | 24.40 | 18.89 | 14.46 | 8.97 |
| 3.5 | | | 17.92 | | |

Fill Volume (mL)

FIG. 3

400B

| | | Model Inputs | | | | | | Run Results | | |
|---|---|---|---|---|---|---|---|---|---|---|
| | | Target Fill Weight (g) | Density (g/mL)* | Target Plunger Depth (mm) | Predicted Required Vacuum (PSI) | # of Tubs filled | # Container Measured | Measured Plunger Depth Avg. (mm) | StdDev. (mm) | % Diff |
| Syringe Volumes Tested | 0.2 mL | 0.244 g | 1.062 | 37 | 0.67 | 1 | 20 | 36.69 | 0.323 | -0.84 |
| | | | | 34 | 1.59 | 3 | 60 | 33.90 | 0.265 | -0.29 |
| | | | | 31 | 2.51 | 1 | 20 | 31.00 | 0.227 | 0.00 |
| | 0.4 mL | 0.450 g | 1.062 | 32 | 0.36 | 1 | 20 | 31.55 | 0.325 | -1.42 |
| | | | | 29 | 1.38 | 3 | 60 | 28.75 | 0.353 | -0.87 |
| | | | | 26 | 2.50 | 1 | 20 | 25.88 | 0.425 | -0.46 |
| | 0.8 mL | 0.850 g | 1.062 | 18 | 1.60 | 1 | 20 | 17.54 | 0.300 | -2.59 |
| | | | | 15 | 3.12 | 3 | 60 | 14.73 | 0.382 | -1.82 |
| | | | | 12 | 4.65 | 1 | 20 | 12.24 | 0.382 | 1.98 |

FIG. 4B

500

| Plunger Depth (mm) | 0.2 | 0.25 | 0.3 | 0.35 | 0.4 | 0.45 | 0.5 | 0.55 | 0.6 | 0.65 | 0.7 | 0.75 | 0.8 | 0.85 | 0.9 | 0.95 | 1.0 | 1.05 | 1.1 |
|---|---|---|---|---|---|---|---|---|---|---|---|---|---|---|---|---|---|---|---|
| 39.0 | 0.21 | | | | | | | | | | | | | | | | | | |
| 38.0 | 0.19 | | | | | | | | | | | | | | | | | | |
| 37.0 | 0.16 | | | | | | | | | | | | | | | | | | |
| 36.0 | 0.13 | 0.23 | | | | | | | | | | | | | | | | | |
| 35.0 | 0.10 | 0.20 | | | | | | | | | | | | | | | | | |
| 34.0 | 0.07 | 0.17 | | | | | | | | | | | | | | | | | |
| 33.0 | 0.04 | 0.14 | 0.24 | | | | | | | | | | | | | | | | |
| 32.0 | 0.01 | 0.11 | 0.21 | | | | | | | | | | | | | | | | |
| 31.0 | -0.02 | 0.08 | 0.18 | | | | | | | | | | | | | | | | |
| 30.0 | -0.04 | 0.05 | 0.15 | | | | | | | | | | | | | | | | |
| 29.0 | -0.07 | 0.02 | 0.11 | 0.22 | | | | | | | | | | | | | | | |
| 28.0 | -0.10 | -0.01 | 0.08 | 0.19 | | | | | | | | | | | | | | | |
| 27.0 | -0.13 | -0.04 | 0.05 | 0.16 | | | | | | | | | | | | | | | |
| 26.0 | -0.16 | -0.07 | 0.02 | 0.12 | 0.23 | | | | | | | | | | | | | | |
| 25.0 | -0.19 | -0.10 | -0.01 | 0.09 | 0.20 | | | | | | | | | | | | | | |
| 24.0 | -0.22 | -0.13 | -0.04 | 0.08 | 0.17 | | | | | | | | | | | | | | |
| 23.0 | -0.25 | -0.16 | -0.07 | 0.03 | 0.13 | 0.25 | | | | | | | | | | | | | |
| 22.0 | | -0.19 | -0.10 | -0.01 | 0.010 | 0.21 | | | | | | | | | | | | | |
| 21.0 | | -0.22 | -0.13 | -0.04 | 0.07 | 0.18 | | | | | | | | | | | | | |
| 20.0 | | | -0.16 | -0.07 | 0.03 | 0.14 | | | | | | | | | | | | | |
| 19.0 | | | -0.20 | -0.10 | -0.00 | 0.11 | 0.23 | | | | | | | | | | | | |
| 18.0 | | | -0.23 | -0.14 | -0.04 | 0.07 | 0.19 | | | | | | | | | | | | |
| 17.0 | | | | -0.17 | -0.07 | 0.04 | 0.15 | | | | | | | | | | | | |
| 16.0 | | | | -0.20 | -0.10 | 0.00 | 0.12 | 0.24 | | | | | | | | | | | |
| 15.0 | | | | -0.23 | -0.14 | -0.03 | 0.08 | 0.20 | | | | | | | | | | | |
| 14.0 | | | | | -0.17 | -0.07 | 0.04 | 0.16 | | | | | | | | | | | |
| 13.0 | | | | | -0.20 | -0.10 | 0.01 | 0.13 | | | | | | | | | | | |
| 12.0 | | | | | -0.24 | -0.14 | -0.03 | 0.09 | 0.22 | | | | | | | | | | |
| 11.0 | | | | | | -0.17 | -0.07 | 0.05 | 0.18 | | | | | | | | | | |
| 10.0 | | | | | | -0.21 | -0.10 | 0.01 | 0.14 | | | | | | | | | | |
| 9.0 | | | | | | -0.24 | -0.14 | -0.03 | 0.10 | 0.23 | | | | | | | | | |
| 8.0 | | | | | | | -0.18 | -0.07 | 0.08 | 0.19 | | | | | | | | | |
| | | | | | | | -0.22 | -0.11 | 0.01 | 0.15 | | | | | | | | | |
| | | | | | | | | -0.14 | -0.03 | 0.11 | | | | | | | | | |
| | | | | | | | | -0.18 | -0.07 | 0.06 | 0.21 | | | | | | | | |
| | | | | | | | | -0.22 | -0.11 | 0.02 | 0.16 | | | | | | | | |
| | | | | | | | | | -0.15 | -0.02 | 0.12 | | | | | | | | |
| | | | | | | | | | -0.19 | -0.07 | 0.07 | 0.22 | | | | | | | |
| | | | | | | | | | -0.23 | -0.11 | 0.03 | 0.18 | | | | | | | |
| | | | | | | | | | | -0.15 | -0.02 | 0.13 | | | | | | | |
| | | | | | | | | | | -0.19 | -0.07 | 0.08 | 0.24 | | | | | | |
| | | | | | | | | | | -0.24 | -0.11 | 0.03 | 0.19 | | | | | | |
| | | | | | | | | | | | -0.16 | -0.02 | 0.14 | | | | | | |
| | | | | | | | | | | | -0.20 | -0.07 | 0.09 | | | | | | |
| | | | | | | | | | | | -0.25 | -0.11 | 0.04 | 0.21 | | | | | |
| | | | | | | | | | | | | -0.16 | -0.01 | 0.15 | | | | | |
| | | | | | | | | | | | | -0.21 | -0.07 | 0.10 | | | | | |
| | | | | | | | | | | | | | -0.12 | 0.04 | 0.23 | | | | |
| | | | | | | | | | | | | | -0.17 | -0.01 | 0.17 | | | | |
| | | | | | | | | | | | | | -0.22 | -0.07 | 0.11 | | | | |
| | | | | | | | | | | | | | | -0.12 | 0.05 | 0.25 | | | |
| | | | | | | | | | | | | | | -0.18 | -0.01 | 0.19 | | | |
| | | | | | | | | | | | | | | -0.23 | -0.07 | 0.12 | | | |
| | | | | | | | | | | | | | | | -0.13 | 0.06 | | | |
| | | | | | | | | | | | | | | | -0.18 | -0.01 | 0.20 | | |
| | | | | | | | | | | | | | | | -0.24 | -0.07 | 0.14 | | |
| | | | | | | | | | | | | | | | | -0.13 | 0.07 | | |
| | | | | | | | | | | | | | | | | -0.20 | -0.00 | 0.23 | |
| | | | | | | | | | | | | | | | | | -0.07 | 0.15 | |
| | | | | | | | | | | | | | | | | | -0.14 | 0.07 | |
| | | | | | | | | | | | | | | | | | -0.21 | -0.00 | |
| | | | | | | | | | | | | | | | | | | -0.08 | 0.17 |
| | | | | | | | | | | | | | | | | | | -0.15 | 0.08 |
| | | | | | | | | | | | | | | | | | | -0.23 | 0.00 |

Fill Volume (mL)

FIG. 5

PREDICTING MACHINE PARAMETERS TO ACHIEVE TARGET SYRINGE PLUNGER DEPTH PLACEMENT

CROSS-REFERENCE TO RELATED APPLICATIONS

This is the United States national phase of International Patent Application No. PCT/US2023/025692, filed Jun. 20, 2023, which claims priority to U.S. Provisional Patent Application No. 63/354,102, filed Jun. 21, 2022, the entire contents of each of which are hereby incorporated by reference herein.

FIELD OF THE DISCLOSURE

The present application relates generally to characterizing a recipe of a system for achieving a target plunger depth when filling a syringe with, for example, a drug product.

BACKGROUND

A syringe filling system may be used for production of pre-filed syringes (PFS) via unit production, batch production, mass production, or continuous production. Syringe filling systems may be used in commercial production (e.g., production of parts for goods or whole goods), scientific production (e.g., production of resources or equipment for scientific research), or other types of production. Syringe filling systems may span disciplines and industries, including, for example, life sciences/engineering, chemical sciences/engineering, medical sciences/engineering, mechanical sciences/engineering, food sciences/engineering, beverage sciences/engineering, as well as manufacturing and assembly corresponding to the aforementioned disciplines and industries. In particular, syringe filling systems are often used in pharmaceutical development, pharmaceutical testing and trials, and pharmaceutical production. Most commonly, liquid drugs are used in filling PFS and the syringe filling systems range in operation size from small to large and may accommodate many different product properties such as liquid viscosities. Syringe filling systems may be manual (e.g., operated by a hand lever used to pump product through a tip), semi-automatic (e.g., operated by pumps controlled by an operator), or automatic (e.g. operated by pumps controlled by a computing device).

Rigorous quality control measures are required for the production of PFS. For drugs in syringes, one such quality control measure includes inspecting each syringe to ensure that the plunger (e.g., rubber piston or stopper) is at the proper depth within the syringe barrel. Plunger depth is typically measured as the distance between the top of the syringe flange and the top of the plunger, while the syringe is in an upright position with the needle pointing downward. Plunger depth is a process-controlled attribute in drug product manufacturing for the production of PFS. Plunger depth may have certain specification limits which may be imposed by either a manufacturer on a product-by-product basis or by a regulatory entity, such as a governmental entity (e.g., the Food and Drug Administration), and with which the PFS must adhere. The plunger depth is typically checked during the fill process and, for combination/auto-injection devices, a second time prior to assembly. Plunger depth is important in ensuring that the PFS will function properly. For example, if the plunger depth is placed too high, the PFS may not dispense all the product out or can even inject product prematurely. If the plunger depth is placed too low, then product may seep into the ribs of plungers creating dried residue and posing a sterility risk. Furthermore, if plunger depth is too far from optimal height, the chances of glass breakage of the PFS during, for example, injection of large bolus of air into patients, is increased.

The plunger depth when filling a syringe is affected by a pressure difference between (1) inside the syringe between the bottom of the plunger and the top of the product, and (2) the space outside the syringe (e.g., approximately atmospheric pressure). Syringe filling systems which may include the Bausch+Ströbel VarioSys®, Optima® aseptic filling machines, the Nest Syringe Vial Line (NSVL) fillers, or the VarioSys® syringe filling system use a vacuum device to create the pressure difference for placing the plunger in the desired position. Conventionally, to achieve the desired plunger depth a plunger depth calibration is performed before each batch of filled units is produced. During calibration, once the syringe is filled in accordance with the vacuum settings entered by an operator, the plunger depth may be compared with specification limits. If the plunger depth is outside the specification limits, the vacuum parameters may be adjusted and the syringe filling process may be repeated iteratively until the plunger depth is within the specification limits using a "guess and check" methodology. Furthermore, day-to-day variability of the syringe filling system may warrant additional adjustment to the vacuum with conventional techniques.

However, these conventional methods of selecting vacuum settings via "guess and check" provides no insight to an operator of the syringe system as to the transferability of the selected vacuum settings when changes are made. Changes may include changing the syringe filling system (e.g., scaling up manufacturing of the PFS to a larger facility using different syringe filling systems), changing the dose size of the product in the PFS (e.g., adjusting dose size due to new drug research), changing the type of syringe or the type of the plunger in the PFS (e.g., switching to a syringe with a different interior diameter and a corresponding different hold-up volume), changing the target plunger depth (due to, e.g., regulatory changes), changing the density of the product (e.g., manufacturing a PFS with a new drug not previously used in PFS manufacturing), etc. With these conventional methods, syringe filling systems will routinely endure extensive recalibration procedures each time a change is made in the syringe filling process or the PFS product, which can be costly in terms of time, labor, and other resources.

BRIEF SUMMARY

Aspects of the present disclosure provide a method for characterizing a recipe of a syringe filling system, including: (a) receiving a first value of a plunger depth for a first syringe; (b) receiving first values of one or more product parameters; (c) determining, by the one or more processors applying the first value of the plunger depth and the first values of the product parameters as inputs to a model, one or more first values of one or more vacuum parameters of the syringe filling system for use when filling the first syringe with a product having the first values of the product parameters, wherein the model uses one or more experimentally-determined correction factors to model a relationship between the plunger depth, the product parameters, and the vacuum parameters; and (d) displaying or storing, by the one or more processors, the first values of the vacuum parameters.

In some aspects, the first value of the plunger depth is a distance value or a volume value. In some aspects, the first values of the product parameters include one or more of: a fill volume value, a fill mass value, or a fill weight value. In some aspects, first values of the product parameters include two or more of: (i) the fill volume value; (ii) the fill mass value or the fill weight value; or (iii) a product density value. In some aspects, the first values of the vacuum parameters include a vacuum pressure value.

In some aspects, the model models a relationship between the plunger depth, the product parameters, the vacuum parameters, and one or more of: (i) an interior size of the first syringe; (ii) a syringe-plunger contact distance of the first syringe; (iii) a plunger stopper height in a barrel of the first syringe; (iv) a hold up volume of the first syringe; or (v) a plunger cone volume of the first syringe.

In some aspects, the method further includes causing one or more vacuums of the syringe filling system to operate at the first values of the vacuum parameters.

In some aspects, the method further includes (a) receiving a second value of the plunger depth for a second syringe, wherein the second syringe is a different size than the first syringe; (b) receiving second values of the one or more product parameters; (c) determining, by applying the second value of the plunger depth and the second values of the product parameters as inputs to the model, one or more second values of the one or more vacuum parameters of the syringe filling system for use when filing the second syringe with a product having the second values of the product parameters; and (d) displaying or storing the second values of the one or more vacuum parameters.

In some aspects, the method further includes determining, for the syringe filling system, the one or more experimentally-determined correction factors based on experimentally relating the plunger depth, vacuum pressure, and product fill amount.

Another aspect of the present disclosure provides computer-readable media storing instructions that, when executed by one or more processors, cause the one or more processors to perform the method of any one of the previous aspects.

Another aspect of the present disclosure provides a system including, (a) one or more processors; and (b) one or more non-transitory, computer-readable media storing instructions that, when executed by the one or more processors, cause the one or more processors to perform the method of any one of the previous aspects.

BRIEF DESCRIPTION OF THE DRAWINGS

The skilled artisan will understand that the figures described herein are included for purposes of illustration and are not limiting on the present disclosure. The drawings are not necessarily to scale, emphasis instead being placed upon illustrating the principles of the present disclosure. It is to be understood that, in some instances, various aspects of the described implementations may be shown exaggerated or enlarged to facilitate an understanding of the described implementations. In the drawings, like primary characters throughout the various drawings generally refer to functionally similar or structurally similar components.

FIG. 3 depicts example data of plunger depth averages for required vacuum versus required vacuum fill volume.

FIGS. 4A and 4B depict an example of model prediction performance data.

FIG. 5 depicts a three-dimensional plot representing model prediction data for two different syringe filling systems.

DETAILED DESCRIPTION

The present disclosure aims to reduce problems with conventional techniques (e.g., as described in the Background section) by providing techniques for characterizing a recipe of a syringe filling system. The present techniques may apply values of plunger depth and product parameters as inputs to a model in order to determine values of vacuum parameters of the syringe filling system, for use when filling a syringe with a product having particular values of the product parameters. By determining, displaying, and storing values of the vacuum parameters, the techniques aim to characterize a recipe of a syringe filling system to provide insight to an operator of the syringe filling system, allowing for transferability of the recipe of a syringe filling system and thereby avoiding the numerous disadvantages associated with conventional techniques.

When an operator of a syringe filling system makes decisions regarding setting a vacuum for achieving a certain plunger depth, it is advantageous for the operator to have certain insights related to the impact of product parameters, vacuum parameters, the interior size of the syringe, the syringe-plunger contact distance of the syringe, the plunger stopper height in the barrel of the syringe, the holdup volume of the syringe, the plunger cone volume of the syringe, etc., on the ultimate plunger depth of the syringe. Accordingly, the operator may use these insights generated by the present techniques to, for example, improve performance or efficiency of the syringe filling system.

Advantageously, by providing improved insights, the present techniques may largely avoid the conventional practice of essentially guessing at vacuum settings in an attempt to achieve a certain plunger depth. Reducing the guessing via improved insights brings numerous advantages. One advantage is that less resources (e.g., drug product) are wasted while calibrating the syringe filling system, and, accordingly, resource efficiency is increased and sustainability of the syringe filling system is improved. By making the syringe filling system more sustainable with respect to resource use, energy efficiency of the syringe filling system may also be improved and the financial or economic cost of producing each syringe may also be reduced. Another advantage of the improved insights is that production throughput may increase as more syringes can be produced in a given amount of time with lower calibration time.

Additional advantages of the present techniques over conventional approaches characterizing a recipe of a syringe filling system will be appreciated throughout this disclosure by one having ordinary skill in the art. The various concepts and techniques introduced above and discussed in greater detail below may be implemented in any of numerous ways, and the described concepts are not limited to any particular manner of implementation. Examples of implementations are provided below for illustrative purposes.

Exemplary System

Figure 1:
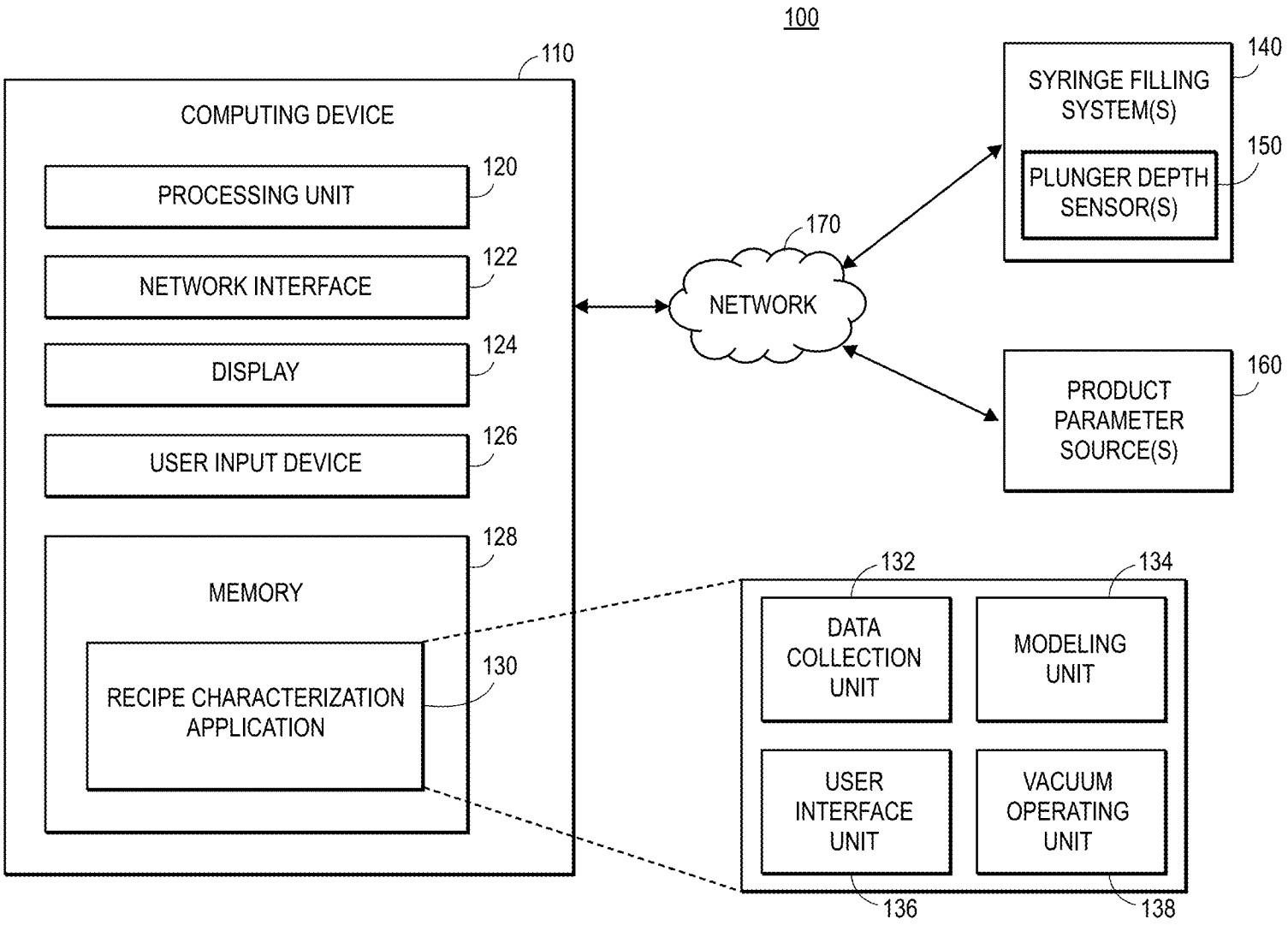
FIG. 1 is a simplified block diagram of an example system for characterizing a recipe of a syringe filling system.

FIG. 1 is a simplified block diagram of an example system 100 for characterizing a recipe of a syringe filling system 140 for achieving a target plunger depth when filling a syringe with, for example, a drug product. In some aspects, the system 100 may include standalone equipment, though in other examples the system 100 may be incorporated into other equipment. At a high level, the system 100 includes components of a computing device 110, one or more syringe filling systems 140, one or more plunger depth sensors 150, and one or more product parameter sources 160. One or more of the components of the system 100 may be communicatively coupled using, for example, wired (e.g., via wires/cables, an address/data bus, or other suitable means) or wireless means. In FIG. 1, the computing device 110, the syringe filling systems 140, and product parameter sources 160 are communicatively coupled via a network 170, which may be or include a proprietary network, a secure public internet, a virtual private network, or any other type of suitable network (e.g., dedicated access lines, satellite links, cellular data networks, combinations of these, etc.). In embodiments where the network 170 comprises the Internet, data communications may take place over the network 170 via an Internet communication protocol. In some aspects, more or fewer instances of the various components of the system 100 than are shown in FIG. 1 may be included in the system 100 (e.g., one instance of the computing device 110, ten instances of the syringe filling systems 140, ten instances of the plunger depth sensors 150, two instances of the product parameter sources 160, etc.)

The syringe filling systems 140 may include a single syringe filling system, or multiple syringe filling systems that are either co-located or remote from each other that may be suitable for a wide range of container types and applications and may allow for production of clinical samples and small commercial batches with an aseptic filling line. The syringe filling systems 140 may generally include physical devices configured for use in producing (e.g., manufacturing) syringes filled with a product. In some embodiments, the syringe filling systems 140 may be used for filling syringes with drugs, chemicals, biological matter, or other matter relevant to pharmaceutical development or production. In other embodiments, the syringe filling systems 140 include equipment that is used in a process unrelated to pharmaceutical development or production (e.g., a food or beverage production system, an oil production system, etc.).

Examples of the syringe filling systems 140 may include the Bausch+Ströbel VarioSys®, Optima® aseptic filling machines, the Nest Syringe Vial Line (NSVL) fillers, or the VarioSys® syringe filling system. The syringe filling systems 140 may include an isolator (e.g., which may be the Vanrx® SA 25, or other isolators) and machine modules which may be used for commercial manufacturing, clinical filling, filling personalized medicines, flexible contract manufacturing, product and process development, etc. The syringe filling systems 140 may be standalone equipment or may be incorporated into other equipment. The syringe filling systems 140 may be a gloveless system and may use peristaltic or time/pressure filling.

The syringe filling system 140 may, in some embodiments, be connected with the computing device 110 either via the network 170, or directly, allowing for at least some of the functionality of the syringe filling system 140 to be controlled by the computing device 110. In some embodiments, the syringe filling system 140 may be capable of receiving instruction directly from a user (e.g., the syringe filling system 140 may be manually-configurable). For example, in some embodiments, the syringe filling system 140 may receive instructions directly from a user to control operation (e.g., a vacuum device of the syringe filling system 140 may be set to operate according to input from a user).

The plunger depth sensors 150 may be included in the syringe filling systems 140 (e.g., integrated into the syringe filling systems 140) or may be external sensors connected to the syringe filling systems 140. The plunger depth sensors 150 may be used to measure plunger depth of syringes (e.g., directly or indirectly) by collecting sensor data regarding plunger depth of syringes (such as distance values or volume values) produced by the syringe filling systems 140. The plunger depth sensors 150 may provide the sensor data to, for example, the computing device 110 (e.g., via the network 170). The provided sensor data may be any suitable data type, such as nominal data, ordinal data, discrete data, or continuous data. The provided sensor data may be in the form of a suitable data structure, which may be stored in a suitable format such as of one or more of: JSON, XML, CSV, etc. The sensor data may be collected or provided automatically, or in response to a request. For example, a user of the computing device 110 may wish to characterize a recipe of the syringe filling system 140. In response, one or more of the plunger depth sensors 150 may collect and provide sensor data to the computing device 110. In some embodiments, one or more of the plunger depth sensors 150 may include databases of data/information relating to the vacuum parameters or may be configured to receive data/information relating to the vacuum parameters, such as via user input.

The syringe filling systems 140 may further include one or more vacuum devices (not shown) used in filling syringes with drug product. The vacuum devices may be, for example, wet vacuum pumps or dry vacuum pumps, and may be entrapment vacuum pumps or gas transfer vacuum pumps (e.g., kinetic vacuum pumps or positive displacement vacuum pumps). The vacuum devices may operate according to one or more vacuum parameters, including one or more of: pressure (measured in, e.g., Pascals, standard atmospheres, Torr, pounds per square inch, technical atmosphere, barad, millimeters of mercury, millimeters of water lift/column, or any other suitable units of measure of pressure), flow rate (measured in, e.g., cubic feet per minute, liters per minute, gallons per minute, or any other suitable units of flow rate), power (measured in, e.g., watts, horsepower, or other suitable units of power), electrical measurements (measured in, e.g., voltage, current, or other suitable units of electrical measurement), rate of rotation (applicable to rotary vacuum pumps, measured in, e.g., rotations/revolutions per minute, radians per second, or other suitable units of rotation rate), or other parameters relating to vacuum pumps.

The syringe filling systems 140 may be configured to be controllable via manual or automated inputs. In some embodiments, the syringe filling systems 140 may be configured to receive such control inputs locally, such as via a user input device local to the syringe filling systems 140. In some embodiments, the syringe filling systems 140 are configured to receive control inputs remotely, such as from the computing device 110 (e.g., via the network 170). The control inputs may include operation instructions, such as values of vacuum parameters according to which the vacuum devices of the syringe filling systems 140 should operate.

Referring now to the product parameter sources 160, the product parameter sources 160 generally include product parameter information that may correspond to one or more products which may be filled into one or more syringes using the syringe filling system 140, such as liquid products which may be drug products. The product parameter information may include one or more values of one or more product parameters, such as, a volume value, a fill mass value, a fill weight value, a fill height value, or a density value. Generally, the product parameter information may include information about one or more properties of the product, or information about an amount of the product. The values of the one or more product parameters may be historical values (e.g., a historical fill mass volume for a given drug) or new values (e.g., values collected or measured presently or recently). In some embodiments, the system 100 may omit the product parameter sources 160, and instead receive product parameter information locally, such as via user input at the computing device 110.

Referring now to the computing device 110, the computing device 110 may be included in the system 100. The computing device 110 may include a single computing device, or multiple computing devices that are either co-located or remote from each other. The computing device 110 is generally configured to apply values of plunger depth and product parameters as inputs to a model in order to determine values of vacuum parameters of the syringe filling system, for use when filling a syringe with a product having particular values of the product parameters, and display or store the values of the vacuum parameters.

Components of the computing device 110 may be interconnected via an address/data bus or other means. The components included in the computing device 110 may include a processing unit 120, a network interface 122, a display 124, a user input device 126, and a memory 128, discussed in further detail below.

The processing unit 120 includes one or more processors, each of which may be a programmable microprocessor that executes software instructions stored in the memory 128 to execute some or all of the functions of the computing device 110 as described herein. Alternatively, one or more of the processors in the processing unit 120 may be other types of processors (e.g., application-specific integrated circuits (ASICs), field-programmable gate arrays (FPGAs), etc.).

The network interface 122 may include any suitable hardware (e.g., front-end transmitter and receiver hardware), firmware, or software configured to use one or more communication protocols to communicate with external devices or systems (e.g., the plunger depth sensors 150, the syringe filling systems 140, the product parameter sources 160, etc.). For example, the network interface 122 may be or include an Ethernet interface. Using the network interface 122, the computing device 110 may be able to communicate with any device(s) via a single communication network, or via multiple communication networks of one or more types (e.g., one or more wired or wireless local area networks (LANs), or one or more wired or wireless wide area networks (WANs) such as the Internet or an intranet, etc.).

The display 124 may use any suitable display technology (e.g., LED, OLED, LCD, etc.) to present information to a user, and the user input device 126 may be a keyboard or other suitable input device. In some aspects, the display 124 and the user input device 126 are integrated within a single device (e.g., a touchscreen display). Generally, the display 124 and the user input device 126 may combine to enable a user to interact with graphical user interfaces (GUIs) or other (e.g., text) user interfaces provided by the computing device 110 (e.g., for purposes such as displaying data/information, recommending changes to one or more vacuum parameters, notifying users of equipment faults or other deficiencies, etc.).

The memory 128 includes one or more physical memory devices or units containing volatile or non-volatile memory, and may or may not include memories located in different computing devices of the computing device 110. Any suitable memory type or types may be used, such as read-only memory (ROM), solid-state drives (SSDs), hard disk drives (HDDs), etc. The memory 128 stores instructions of one or more software applications that can be executed by the processing unit 120, including a recipe characterization (RC) application 130. In the example system 100, the RC application 130 includes a data collection unit 132, a modeling unit 134, a user interface unit 136, and a vacuum operating unit 138. The units 132-138 may be distinct software components or modules of the RC application 130, or may simply represent functionality of the RC application 130 that is not necessarily divided among different components/modules. For example, in some embodiments, the data collection unit 132 and the user interface unit 136 are included in a single software module. Moreover, in some embodiments, the units 132-138 are distributed among multiple copies of the RC application 130 (e.g., executing at different components in the computing device 110), or among different types of applications stored and executed at one or more devices of the computing device 110.

The data collection unit 132 is generally configured to receive data. In some embodiments, the data collection unit 132 receives one or more values of one or more product parameters (e.g., a volume value, a fill mass value, a fill weight value, or a density value) of a product with which one or more syringes will be filled. The data collection unit 132 may receive the values of the product parameters via, for example, the product parameter sources 160, user input received via the user interface unit 136 with the user input device 126, or other suitable means. In some embodiments, the data collection unit 132 may receive one or more values of a plunger depth (e.g., a distance value or a volume value) for a syringe. The data collection unit 132 may receive the values of the plunger depth via, for example, the plunger depths sensors 150, user input received via the user interface unit 136 with the user input device 126, or other suitable means.

The modeling unit 134 is generally configured to generate or apply a model that uses one or more experimentally-determined correction factors to model a relationship between the plunger depth, the product parameters, and the vacuum parameters. The modeling unit 134 may receive the plunger depth and the product parameters via the data collection unit 132 or the user interface unit 136, for example. The modeling unit 134 may determine, by applying a value of the plunger depth and values of product parameters as inputs to the model, values of one or more vacuum parameters of the syringe filling system 140 for use when filling a syringe with a product having the product parameters.

The user interface unit 136 is generally configured to receive user input. For example, the user interface unit 136 may receive user input for values of one or more product parameters or values for one or more plunger depths. The user interface unit 136 may cooperate with the user input device 126.

The vacuum operating unit 138 is generally configured to cause a vacuum device of the syringe filling system 140 to operate using a vacuum parameter. The vacuum parameter may be a user selection received via the user interface unit 136, or the vacuum parameter may have been determined by the modeling unit 134 using the model. In other embodiments, the vacuum operating unit 138 is omitted (e.g., the vacuum device of the syringe filling system 140 is instead manually configured with a vacuum parameter).

The operation of each of the units 132-138 is described in further detail below, with reference to the operation of the system 100.

Exemplary Plunger Insertion Process

Figure 2A:
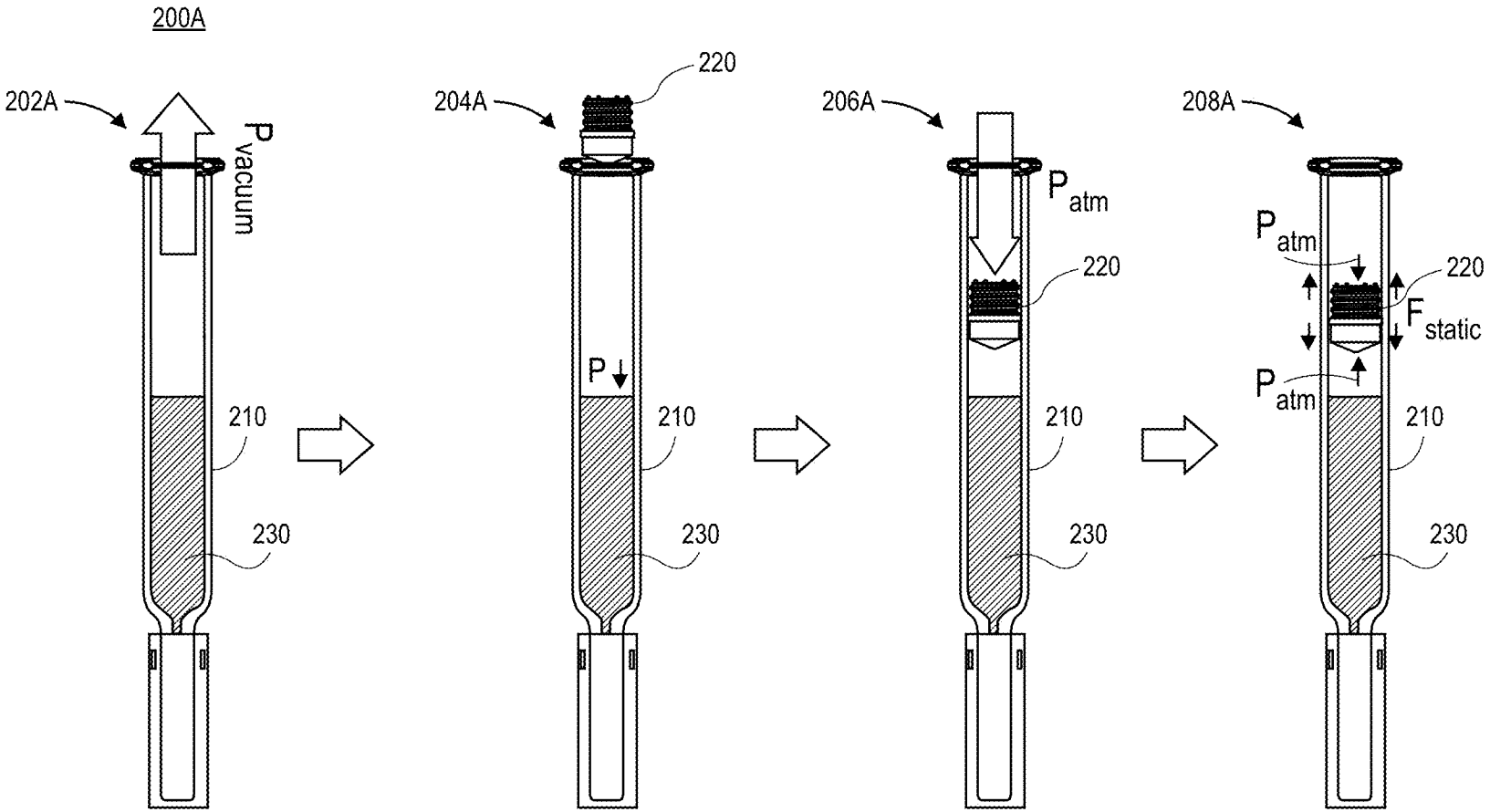
FIG. 2A depicts an example plunger insertion process.

FIG. 2A depicts an example plunger insertion process 200A for inserting a plunger 220 into a syringe 210. As illustrated, the process 200A includes vacuuming a syringe barrel at a stage 202A, aligning a plunger at a stage 204A, equilibrating the plunger position at a stage 206A, and arriving at an equilibrated plunger position in a stage 208A. The process 200A may be performed using equipment/apparatuses that may be the same as or similar to those discussed above in connection with the system 100. For example, the one or more filling systems 140 may be used to perform at least some of the process 200A.

Stage 202A of the process 200A may include starting a vacuum device (e.g., the vacuum device discussed with respect to the syringe filling systems 140) to create a vacuum in the syringe 210 that is filled with a product 230 (e.g., a drug product). The vacuum device may operate according to one or more vacuum parameters including one or more of: pressure, flow rate, power, electrical measurements, rate of rotation, or other parameters. The vacuum parameters may be provided to the vacuum device via user input, such as by an operator.

Stage 204A of the process 200A may include aligning the plunger 220 over the top opening of the syringe 210. The alignment of the plunger 220 may be done mechanically by machinery (e.g., the isolator of the syringe filling systems 140). Aligning the plunger 220 with the syringe 210 may create an air-tight seal inside the syringe 210 with respect to outside the syringe 210.

Stage 206A of the process 200A may include the plunger 220 moving inward into the syringe 210 due to a pressure difference between the inside of the syringe 210 and the outside of the syringe 210 (e.g., with the latter at atmospheric pressure $P_{atm}$). More specifically, the pressure inside the syringe 210 is lower than the pressure outside the syringe 220. No external forces may need to be applied to the plunger 220 during stage 206A, as the pressure difference alone may be sufficient to cause the plunger 220 to be "sucked" lower into the syringe 210.

At stage 208A of the process 200A, the pressure inside the syringe 210 (i.e., above the product 230 and below the plunger 220, as illustrated) is equal to the pressure outside the syringe 210 (e.g., $P_{atm}$). After settling for a pre-determined amount of time (e.g., 20 minutes at stage 206A) the plunger 220 may be considered to be "settled" and the pressure inside the syringe 210 and outside the syringe 210 may be equal or substantially equal (e.g., with any remaining pressure difference being insufficient to overcome the friction of the plunger 220 and the walls of the barrel of the syringe 210), at which point, a plunger depth of the plunger 220 may be measured. The plunger depth may be measured using measurement tools like sensors (e.g., the plunger depth sensors 150), or manually measured.

Exemplary Syringe Filled Via a Syringe Filling System

Figure 2B:
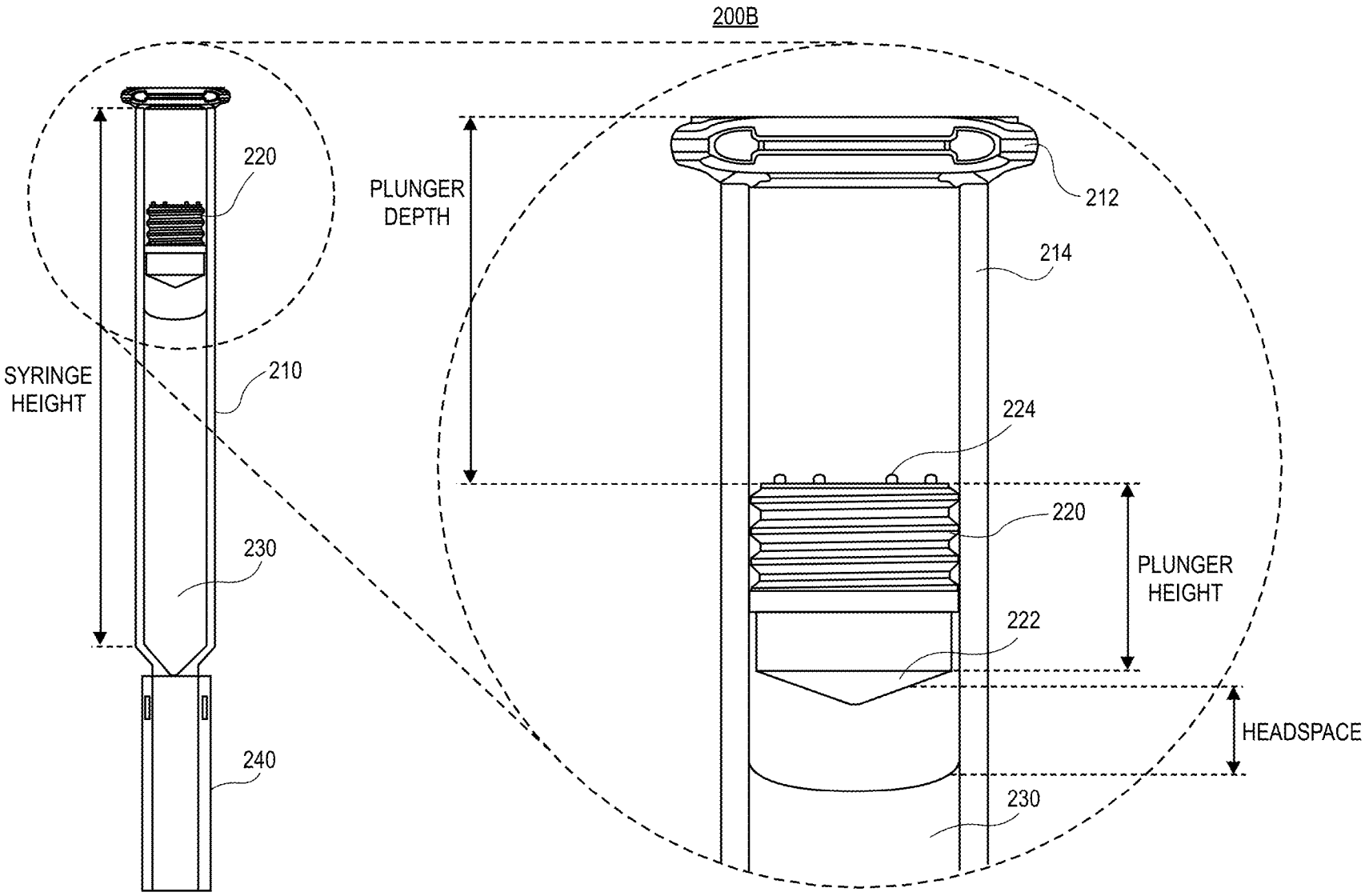
FIG. 2B depicts an example syringe having an example plunger depth.

FIG. 2B depicts a more detailed depiction of the syringe 210, the plunger 220, and the product 230 of the process 200A of FIG. 2A, according to one example. FIG. 2B depicts a flange 212 and a barrel 214 of the syringe 210 as well as a plunger cone 222 and one or more lugs 224 of the plunger 220. FIG. 2B further depicts a needle shield 240 to protect and cover the needle of the syringe 210. The syringe 210 may have been filled using the syringe filling system 140, or may have been filled using the process 200A, for example.

FIG. 2B depicts one way in which plunger depth may be defined. It is understood, however, that any suitable definition or technique may be used (e.g., by the data collection unit 132 using the plunger depth sensors 150) to define or measure plunger depth. In FIG. 2B, the syringe 210 includes the plunger 220 disposed within the barrel 214. The proximal end of the barrel 214 (and of the syringe 210 as a whole) forms the flange 212, while a needle (obscured by the needle shield 240 in FIG. 2B) is positioned at the distal end of the syringe 210. Typically, the barrel 214 and flange 212 are formed of glass, while the plunger 220 is formed of rubber. However, other materials may be used for either component (e.g., suitable types of plastic).

In the example embodiment shown, plunger depth for the syringe 210 is defined as the distance between (1) a top or proximal surface of the flange 212 and (2) a top or proximal surface of the plunger 220. However, defining of the plunger depth may be complicated by several factors. For example, the top surface of the flange 212 may be uneven (e.g., undulating with distinct peaks and troughs or having beveled edges), in which case the average or peak values (smallest distance/depth) of the flange top surface 212 may be used. As another example, as shown in FIG. 2B, the plunger 220 may have small, protruding "lugs" or "dimples" 224, which may be ignored (e.g., discarding the measurements/samples corresponding to the lugs 224 prior to averaging). Plunger depth may also be influenced by other factors, such as the orientation of the syringe 210 within its holder (e.g., star wheel, tub, Rondo tray, etc.). For example, if the syringe 210 is in a tray or a tub, it would likely be suspended from the flange 212, which may not be perfectly orthogonal to the cylindrical body of the syringe 210. This can result in a slight tilt or squint, with an angular displacement. The plunger 220, too, may sit slightly squint in the barrel 214. In these examples, the plunger depth may be measured by accounting for angular displacement (e.g., by identifying an angle of the angular displacement).

FIG. 2B also depicts one way in which headspace may be defined. It is understood, however, that any suitable definition or technique may be used (e.g., by the data collection unit 132 using the plunger depth sensors 150) to define headspace. In the example embodiment shown, headspace for the syringe 210 is defined as the distance between (1) a bottom or distal surface of the plunger 220 and (2) a top or proximal surface of the product 230. However, defining the headspace may be complicated by several factors. For example, the bottom surface of the plunger 220 may be uneven. For example, as illustrated, the bottom edge of the plunger 220 may include the plunger cone 222. As another example, the top surface of the product 230, as illustrated, may be uneven due to, for example, a meniscus. Similar to plunger depth, average or peak values (smallest distance/depth) of the bottom surface of the plunger 220 and the top surface of the product 230 may be used in defining the headspace.

Exemplary Plunger Depth Average Data

FIG. 3 depicts example data 300 comprising plunger depth averages for required vacuum (in PSI) versus required vacuum fill volume (in mL). As illustrated, the data 300 characterizes the plunger depths for five different fill volumes: 0.25 mL, 0.45 mL, 0.65 mL, 0.85 mL, and 1.05 mL and 5 different vacuum pressures: 0.5 PSI, 1.0 PSI, 1.5 PSI, 2.0 PSI, 2.5 PSI, 3.0 PSI, and 3.5 PSI. While these fill volumes are included in the example data 300, it should be understood that the techniques described herein can apply to a number of different fill volumes (e.g., 1.00 mL syringes, 2.25 mL syringes, 3.00 mL syringes, etc.). The data 300 may be experimentally-determined by measuring plunger depths for the five different fill volumes and five different vacuum pressures using, for example, the plunger depth sensors 150 and then averaging the measured plunger depths. The data 300 show that plunger depth increases with increasing vacuum pressure and decreasing fill volume.

The data 300 may be used to determine experimentally correction factors in a model that uses one or more experimentally-determined correction factors to model a relationship between the plunger depth, product parameters (e.g., fill volume), and the vacuum parameters (e.g., vacuum pressure). The model using the one or more experimentally-determined correction factors, based on the data 300, may be based on the following equation:

(Equation 1)

$$Req.\ Vac. = \frac{P_{STM} * A * \left(\frac{\pi * d_i^2}{4} * (h_s - h_{pd} - h_p) - \frac{m_{fw}}{\rho} + V_{huv} - V_{PST} + B\right)}{\frac{\pi * d_i^2}{4} * h_s - \frac{m_{fw}}{\rho} + V_{huv} - V_{PST} + B},$$

where $m_w$ is mass of fill weight of the product, $P_{ATM}$ is the absolute pressure of atmosphere, $d_i$ is the interior diameter of the syringe, $h_s$ is the syringe height shown for example in FIG. 2B (i.e., the length of the barrel of the syringe not including bevels and the plunger cone, which is the length of the conical tube section which the plunger slides along in the syringe, and for which barrel length is a close approximation), $h_{pd}$ is the plunger depth shown for example in FIG. 2B (i.e., the length of the plunger stopper from the top flat surface of the plunger to the beginning of the plunger cone, not including the tip cone section), $h_p$ is the plunger height shown for example in FIG. 2B (i.e., the length of the surface of the plunger that contacts the interior barrel of the syringe, creating an air-tight seal, and not including the plunger cone), $V_{huv}$ is the hold-up volume of the syringe, $V_{PST}$ is the volume of the plunger cone, ρ is the density of the product, A is the ideal gas law correction factor, and B is the geometry and static friction correction factor. The correction factors, A and B, are specific to each syringe and each syringe filling system. Based on the data 300, the plunger depth versus the vacuum pressure versus the fill volume data may be fit to Equation 1 by optimizing A and B to minimize the sum of the mean difference squared. It is understood that alternative quantities may be substituted in Equation 1 while still preserving functionality of the model. For example, rather than the quantity $$\frac{m_{fw}}{\rho},$$

a quantity $V_{fw}$ could be used instead, representing volume of fill weight of the product.

While the data 300 may be used to build a model that uses one or more experimentally-determined correction factors to model a relationship between the plunger depth, product parameters, and the vacuum parameters (using for example, Equation 1), it is worth noting that other models or other training techniques could be used in addition or alternatively. For example, machine learning models may be used (e.g., by the computing device 110 using the RC application 130) to model a relationship between the plunger depth, the product parameters, and the vacuum parameters. Machine-learning programs or algorithms may employ a neural network, which may be a convolutional neural network, a deep learning neural network, or a combined learning module or program that learns in two or more features or feature datasets in a particular areas of interest. Machine-learning programs or algorithms may also include natural language processing, semantic analysis, automatic reasoning, regression analysis, support vector machine (SVM) analysis, K-Nearest neighbor analysis, naïve Bayes analysis, clustering, reinforcement learning, or other machine-learning algorithms or techniques. Other machine learning models may identify and recognize patterns in training data in order to facilitate making predictions for new data. In some examples, due to processing power requirements of training machine learning models, the model may be trained using additional computing resources (e.g., cloud computing resources) based upon data provided by a server (not illustrated). The training data may be unlabeled (for unsupervised training), or the training data set may be labeled (for supervised training), such as by a human. Training of the model may continue until at least the model is validated and satisfies selection criteria to be used as a predictive model. In some examples, the model may be validated (e.g., by the computing device 110) using a second subset of the training data set (commonly known as "test data") to determine algorithm accuracy and robustness. Such validation may include applying the model to the test data to make predictions. The model may then be evaluated (e.g., by the computing device 110) to determine whether performance is sufficient based upon comparing the predictions to known labels for the test data. Sufficiency criteria for validating the model may vary depending upon the size of the available training data set, the performance of previous iterations of machine learning models, or user-specified performance requirements.

Exemplary Performance Data

Figure 4A:
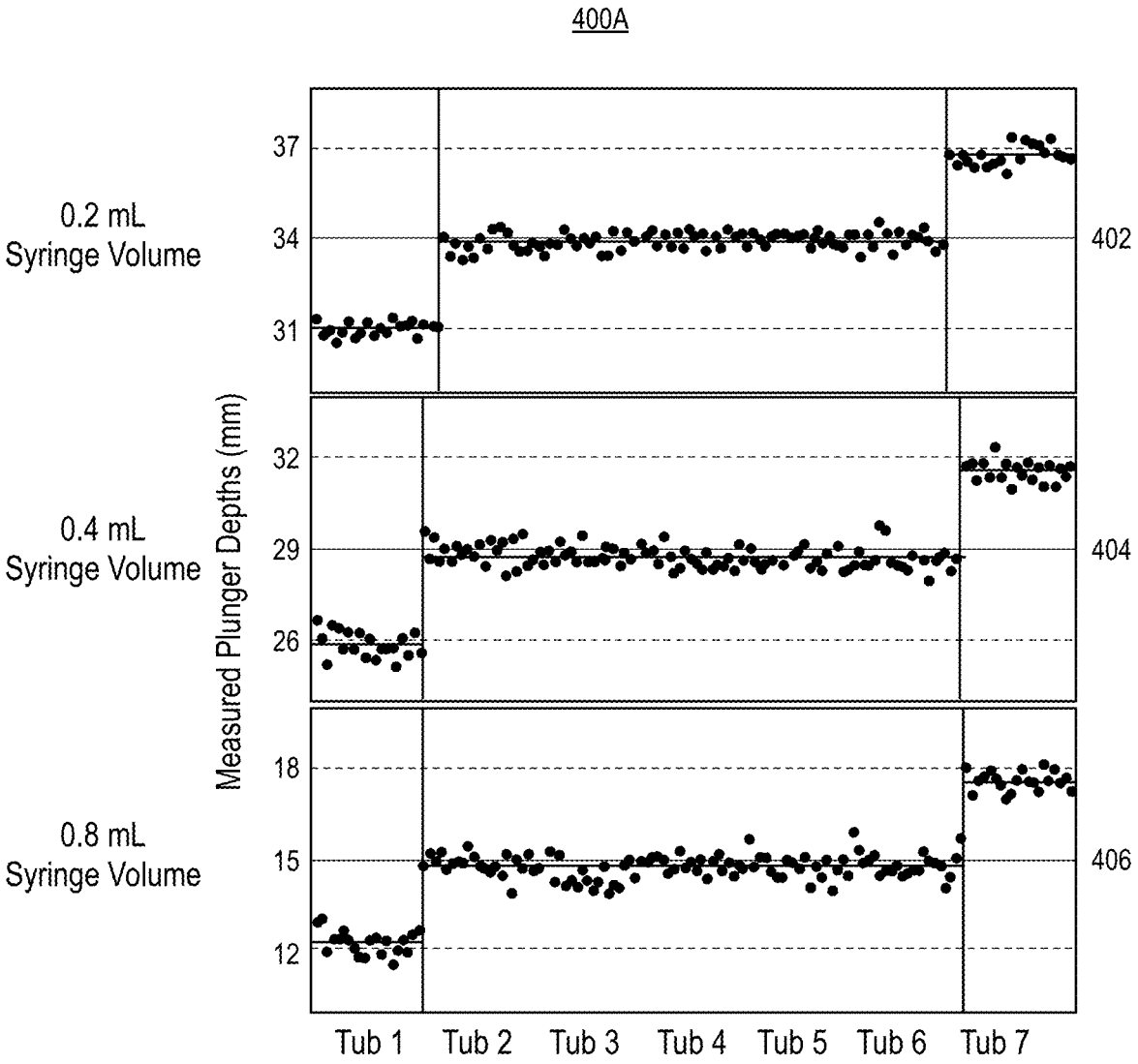

FIG. 4A depicts example data 400A representing performance when predicting vacuum parameters using a model that implements Equation 1. The model may use one or more experimentally-determined correction factors to model a relationship between plunger depth, product parameters (e.g., target fill weight of the product and density of the product), and the vacuum parameters (e.g., predicted required vacuum). The model may be generated in accordance with techniques outlined above with respect to FIG. 3. The model may be used with a syringe filling system that may include one or more components that are the same as or similar to the system 100 of FIG. 1 and may be used to fill syringes using a process which may be the same as or similar to the process 200A.

The data 400A includes actual measured plunger depths plotted for three different syringe sizes having different volumes (i.e., 0.2 mL, 0.4 mL, and 0.8 mL). For each syringe size, the data 400A include actual measured plunger depths for seven different tubs. Tub 1 and tub 7 correspond, for each syringe size, to a target plunger depth near the syringe minimum capacity and maximum capacity, respectively. Tubs 2-6 correspond, for each syringe size, to a target plunger depth near the middle capacity. Each of the actual measured plunger depths correspond to vacuum parameters determined by the model to achieve each respective target plunger depth.

FIG. 4B shows the data 400A of FIG. 4A in a table format, as data 400B. The model inputs and the run results are each included in the data 400B. As illustrated for the model inputs, each syringe size corresponds to a certain target fill weight (i.e., 0.244 g, 0.450 g, and 0.850 g) for a product that has a certain density (i.e., 1.062 g/mL). As illustrated in the run results, the data 400B further include, for each target plunger depth of each syringe size, a measured plunger depth average of the experimentally measured and determined plunger depths when the vacuum of the syringe filling system (e.g., the syringe filling system 140) is set to the corresponding predicted required vacuum for a number of tubs and containers. Finally, the data 400B include in the run results, a standard deviation for each of the measured plunger depth averages and a percentage difference between each of the measured plunger depth averages and the corresponding target plunger depth.

As shown in the data 400A and the data 400B, the presently disclosed techniques of using a model that models a relationship between plunger depth, product parameters, and vacuum parameters provided an accurate prediction of the required vacuum settings to achieve the target plunger depths for all nine target plunger depths, within less than 3% error. Accordingly, the data 400A and the data 400B demonstrate the effectiveness of present techniques in developing a model for predicting vacuum parameters in the specific scenario where there is a transfer from a first syringe size and a first set of product parameters (e.g., a first target fill weight) to a second syringe size and a second set of product parameters (e.g., a second target fill weight).

Exemplary Comparison

FIG. 5 depicts a three-dimensional plot 500 representing model prediction data for two different syringe filling systems. It is worth noting that the model according to present techniques, which may use one or more experimentally-determined correction factors to model a relationship between plunger depth, product parameters, and the vacuum parameters, is compatible with various different types of syringe filling systems. In fact, when applying the model using Equation 1 to a different syringe filling system, adjusting the correction factors (e.g., A and B) may be the only adjustment to the model required.

More specifically, FIG. 5 depicts a plot 500 of predicted vacuum parameters for each of a NSVL syringe filling system and a VarioSys® syringe filling system (one or both of which may be used as the syringe filling system 140 and may fill syringes according to the process 200A). The vacuum parameters for each of the NSVL syringe filling system and the VarioSys® syringe filling system may have been determined (e.g., by the computing device 110 using the RC application 130) using experimentally-determined correction factors that are unique to each syringe filling system that may be applied to Equation 1 (e.g., by the computing device 110 using the RC application 130).

A visual representation is presented in the plot 500 to show how the required vacuum settings for each syringe filling system is impacted by the differences in correction factors. Each cell of the plot 500 corresponds to a particular combination of input fill volume and input plunger depth. Certain cells of the plot 500 include a number that represents, for the corresponding fill volume and plunger depth, the difference between the predicted vacuum pressure for the NSVL syringe filling system and the predicted vacuum pressure for the VarioSys® syringe filling system. In effect, the number in each cell of the plot 500 may be described according to Equation 2, $$\Delta P = P_{NSVL} - P_{VS}, \quad \text{(Equation 2)}$$

where ΔP is the difference between the predicted vacuum pressure (i.e., the number in each cell), $P_{NSVL}$ is the predicted vacuum pressure for the NSVL syringe filling system, and $P_{VS}$ is the predicted vacuum pressure for the VarioSys® syringe filling system.

In using the plot 500, vacuum parameters of fill recipes may be transferred between different syringe filling systems, and, based on the data depicted in the plot 500, it may be possible to achieve a target plunger depth on the first attempt, reducing longer characterization runs and line time. Accordingly, the techniques described herein not only reduce guesswork, but can eliminate the need for testing on clinical lines, allowing use of a pilot scale filler and offsetting the time required for calibration. Therefore, the plot 500 demonstrates the effectiveness of present techniques in developing a model for predicting vacuum parameters that may be transferred between a first syringe filling system using a first set of correction factors and a second syringe filling system using a second set of correction factors.

Exemplary Flow Diagram

Figure 6:
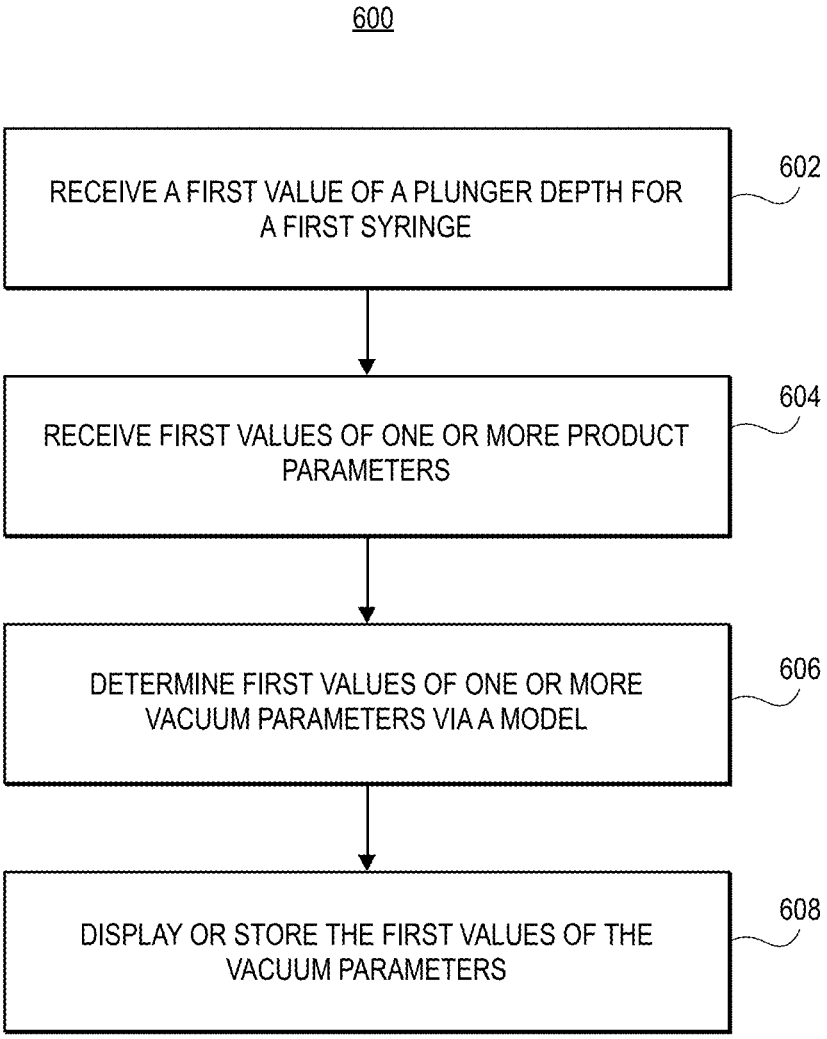
FIG. 6 is a flow diagram depicting an example method for characterizing a recipe of a syringe filling system.

FIG. 6 is a flow diagram depicting an example method for characterizing a recipe of a syringe filling system. The example method 600 may include the following elements: (1) receiving a first value of a plunger depth for a syringe (block 602), (2) receiving one or more first values of one or more product parameters (block 604), (3) determining one or more first values of one or more vacuum parameters via a model (block 606), and (4) displaying or storing the one or more first values of the vacuum parameters (block 608).

Block 602 may include receiving, via the user input device 126 and the user interface unit 136, the first value of the plunger depth as input from an operator. The first values of the plunger depth may correspond to a target plunger depth, a desired plunger depth, or some other plunger depth. The first values of the plunger depth may include a distance value or a volume value that describes or represents a position of a plunger in the syringe. In some embodiments, plunger depth sensors (e.g., the plunger depth sensors 150) measure a particular plunger depth, which may then be received at block 602 as the first value of the plunger depth.

Block 604 may include receiving, via one or more product parameter sources, such as one or more of: the product parameter source 160, the data collection unit 132, the user input device 126, or the user interface unit, the one or more first values of the one or more product parameters. The first values of the product parameters may include one or more of: a volume value, a fill mass value, a fill weight value, fill height value, or a density. In some embodiments, the first values of the product parameters include two or more of: (i) the fill volume value; (ii) the fill mass value or the fill weight value; or (iii) a product density value. In some embodiments, other data/information may be included in the first values of the product parameters that are specific to the product itself such as a product name or chemical/physical properties/information of the product.

Block 606 may include determining, via a computing device such as the computing device 110 applying the first value of the plunger depth and the first values of the product parameters as inputs to a model, the one or more first values of the one or more vacuum parameters of the syringe filling system for use when filling the first syringe with a product having the first values of the product parameters, wherein the model uses one or more experimentally-determined correction factors to model a relationship between the plunger depth, the product parameters, and the vacuum parameters. The model used may be the same as or similar to (or may be representable in the same as or similar manner to) the model discussed with respect to FIG. 3 or FIG. 4 and may be based on Equation 1. The one or more first values of the one or more vacuum parameters may be used with a vacuum device that may be the same as or similar to the vacuum device described with respect to the syringe filling system 140 which may be used to fill syringes with product in a manner that is the same as or similar to the process 200A. The one or more first values of the vacuum parameters may include one or more of: pressure (measured in, e.g., Pascals, standard atmospheres, Torr, pounds per square inch, technical atmosphere, barad, millimeters of mercury, millimeters of water lift/column, or any other suitable units of measure of pressure), flow rate (measured in, e.g., cubic feet per minute, liters per minute, gallons per minute, or any other suitable units of flow rate), power (measured in, e.g., watts, horsepower, or other suitable units of power), electrical measurements (measured in, e.g., voltage, current, or other suitable units of electrical measurement), rate of rotation (applicable to rotary vacuum devices, measured in, e.g., rotations/revolutions per minute, radians per second, or other suitable units of rotation rate), or other parameters relating to vacuum devices.

Block 608 may display or store, via a computing device such as the computing device 110, the first values of the vacuum parameters are displayed or stored. In some aspects the first values of the vacuum parameters themselves may be displayed, while in other aspects a representation of the first values of the vacuum parameters may be displayed. Displaying the first values of the vacuum parameters may specifically use, for example, the display 124 or the user interface unit 136 of the computing device 110. In some embodiments, the first values of the vacuum parameters itself may be stored, while in other aspects a representation of the first values of the vacuum parameters may be stored. Storing the first values of the vacuum parameters may specifically use, for example, the memory 128 of the computing device 110.

In some aspects, the method 600 may be performed either entirely by automation, e.g., by one or more processors (e.g., a CPU or GPU) that execute instructions stored on one or more non-transitory, computer-readable storage media (e.g., a volatile memory or a non-volatile memory, a read-only memory, a random-access memory, a flash memory, an electronic erasable program read-only memory, or one or more other types of memory. The method 600 may use any of the components, processes, or techniques of one or more of FIGS. 1-5.

Additional Considerations

Some of the figures described herein illustrate example block diagrams having one or more functional components. It will be understood that such block diagrams are for illustrative purposes and the devices described and shown may have additional, fewer, or alternate components than those illustrated. Additionally, in various aspects, the components (as well as the functionality provided by the respective components) may be associated with or otherwise integrated as part of any suitable components.

Some aspects of the disclosure relate to a non-transitory computer-readable storage medium having instructions/computer-readable storage medium thereon for performing various computer-implemented operations. The term "instructions/computer-readable storage medium" is used herein to include any medium that is capable of storing or encoding a sequence of instructions or computer codes for performing the operations, methodologies, and techniques described herein. The media and computer code may be those specially designed and constructed for the purposes of the aspects of the disclosure, or they may be of the kind well known and available to those having skill in the computer software arts. Examples of computer-readable storage media include, but are not limited to: magnetic media such as hard disks, floppy disks, and magnetic tape; optical media such as CD-ROMs and holographic devices; magneto-optical media such as optical disks; and hardware devices that are specially configured to store and execute program code, such as ASICs, programmable logic devices ("PLDs"), and ROM and RAM devices.

Examples of computer code include machine code, such as produced by a compiler, and files containing higher-level code that are executed by a computer using an interpreter or a compiler. For example, an aspect of the disclosure may be implemented using Java, C++, or other object-oriented programming language and development tools. Additional examples of computer code include encrypted code and compressed code. Moreover, an aspect of the disclosure may be downloaded as a computer program product, which may be transferred from a remote computer (e.g., a server computer) to a requesting computer (e.g., a computer or a different server computer) via a transmission channel. Another aspect of the disclosure may be implemented in hardwired circuitry in place of, or in combination with, machine-executable software instructions.

As used herein, the singular terms "a," "an," and "the" may include plural referents, unless the context clearly dictates otherwise. This description, and the claims that follow, should be read to include one or at least one and the singular also includes the plural unless expressly stated or it is obvious that it is meant otherwise. As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

As used herein, the terms "approximately." "substantially." "substantial," "roughly" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "substantially" the same if a difference between the values is less than or equal to ±10% of an average of the values, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified.

While the techniques disclosed herein have been described with primary to particular operations performed in a particular order, it will be understood that these operations may be combined, sub-divided, or re-ordered to form an equivalent technique without departing from the teachings of the present disclosure. Accordingly, unless specifically indicated herein, the order and grouping of the operations are not limitations of the present disclosure.

What is claimed:

1. A method for characterizing a recipe of a syringe filling system, comprising:

receiving, by one or more processors, a first value of a plunger depth for a first syringe;

receiving, by the one or more processors, first values of one or more product parameters;

determining, by the one or more processors applying the first value of the plunger depth and the first values of the product parameters as inputs to a model, one or more first values of one or more vacuum parameters of the syringe filling system for use when filling the first syringe with a product having the first values of the product parameters, wherein the model uses one or more experimentally-determined correction factors to model a relationship between the plunger depth, the product parameters, and the vacuum parameters; and displaying or storing, by the one or more processors, the first values of the vacuum parameters.

2. The method of claim 1, wherein the first value of the plunger depth is a distance value or a volume value.

3. The method of claim 1 wherein the model models a relationship between the plunger depth, the product parameters, the vacuum parameters, and one or more of: (i) an interior size of the first syringe; (ii) a syringe-plunger contact distance of the first syringe; (iii) a plunger stopper height in a barrel of the first syringe; (iv) a hold up volume of the first syringe; or (v) a plunger cone volume of the first syringe.

4. The method of claim 1, wherein the first values of the vacuum parameters include a vacuum pressure value.

5. The method of claim 1, further comprising:

causing, by the one or more processors, one or more vacuum devices of the syringe filling system to operate at the first values of the vacuum parameters.

6. The method of claim 1, further comprising:

receiving, by one or more processors, a second value of the plunger depth for a second syringe, wherein the second syringe is a different size than the first syringe;

receiving, by the one or more processors, second values of the one or more product parameters;

determining, by the one or more processors applying the second value of the plunger depth and the second values of the product parameters as inputs to the model, one or more second values of the one or more vacuum parameters of the syringe filling system for use when filing the second syringe with a product having the second values of the product parameters; and displaying or storing, by the one or more processors, the second values of the one or more vacuum parameters.

7. The method of claim 1, further comprising:

determining, by the one or more processors, for the syringe filling system, the one or more experimentally-determined correction factors based on experimentally relating the plunger depth, vacuum pressure, and product fill amount.

8. The method of claim 1, wherein the first values of the product parameters include one or more of: a fill volume value, a fill mass value, or a fill weight value.

9. The method of claim 8, wherein the first values of the product parameters include two or more of: (i) the fill volume value; (ii) the fill mass value or the fill weight value; or (iii) a product density value.

10. One or more non-transitory, computer-readable media storing instructions that, when executed by one or more processors, cause the one or more processors to:

receive a first value of a plunger depth for a first syringe;

receive first values of one or more product parameters;

determine, by applying the first value of the plunger depth and the first values of the product parameters as inputs to a model, one or more first values of one or more vacuum parameters of the syringe filling system for use when filling the first syringe with a product having the first values of the product parameters, wherein the model uses one or more experimentally-determined correction factors to model a relationship between the plunger depth, the product parameters, and the vacuum parameters; and display or store the first values of the vacuum parameters of.

11. A system comprising:

one or more processors; and one or more non-transitory, computer-readable media storing instructions that, when executed by the one or more processors, cause the one or more processors to:

receive a first value of a plunger depth for a first syringe;

receive first values of one or more product parameters;

determine, by applying the first value of the plunger depth and the first values of the product parameters as inputs to a model, one or more first values of one or more vacuum parameters of the syringe filling system for use when filling the first syringe with a product having the first values of the product parameters, wherein the model uses one or more experimentally-determined correction factors to model a relationship between the plunger depth, the product parameters, and the vacuum parameters; and display or store the first values of the vacuum parameters.

12. The system of claim 11, wherein the first value of the plunger depth is a distance value or a volume value.

13. The system of claim 11, wherein the model models a relationship between the plunger depth, the product parameters, the vacuum parameters, and one or more of: (i) an interior size of the first syringe; (ii) a syringe-plunger contact distance of the first syringe; (iii) a plunger stopper height in a barrel of the first syringe; (iv) a hold up volume of the first syringe; or (v) a plunger cone volume of the first syringe.

14. The system of claim 11, wherein the first values of the vacuum parameters include a vacuum pressure value.

15. The system of claim 11, wherein the instructions, when executed, cause the one or more processors to:

cause one or more vacuum devices of the syringe filling system to operate at the first values of the vacuum parameters.

16. The system of claim 11, wherein the instructions, when executed, cause the one or more processors to:

receive a second value of the plunger depth for a second syringe, wherein the second syringe is a different size than the first syringe;

receive second values of the one or more product parameters;

determine, by applying the second value of the plunger depth and the second values of the product parameters as inputs to the model, one or more second values of the one or more vacuum parameters of the syringe filling system for use when filing the second syringe with a product having the second values of the product parameters; and display or store, by the one or more processors, the second values of the one or more vacuum parameters.

17. The system of claim 11, wherein the instructions, when executed, cause the one or more processors to:

determine for the syringe filling system, the one or more experimentally-determined correction factors based on experimentally relating the plunger depth, vacuum pressure, and product fill amount.

18. The system of claim 11, wherein the first values of the product parameters include one or more of: a fill volume value, a fill mass value, or a fill weight value.

19. The system of claim 18, wherein the first values of the product parameters include two or more of: (i) the fill volume value; (ii) the fill mass value or the fill weight value; or (iii) a product density value.

* * * * *